US006778081B2

(12) United States Patent
Matheny

(10) Patent No.: US 6,778,081 B2
(45) Date of Patent: Aug. 17, 2004

(54) FIRE DEPARTMENT STATION ZONED ALERTING CONTROL SYSTEM

(76) Inventor: Richard K. Matheny, 6441 Mukai Ct., Huntington Beach, CA (US) 92647-6160

( * ) Notice: Subject to any disclaimer, the term of this patent is extended or adjusted under 35 U.S.C. 154(b) by 0 days.

(21) Appl. No.: 10/324,448

(22) Filed: Dec. 20, 2002

(65) Prior Publication Data

US 2003/0169154 A1 Sep. 11, 2003

Related U.S. Application Data

(62) Division of application No. 09/544,068, filed on Apr. 6, 2000, now Pat. No. 6,535,121.
(60) Provisional application No. 60/128,464, filed on Apr. 9, 1999.

(51) Int. Cl.[7] ..... G08B 29/00
(52) U.S. Cl. ..... 340/506; 340/825.19; 340/286.02; 340/286.05; 340/286.06; 340/286.07; 340/293; 340/294; 340/815.4; 340/815.69; 340/3.1; 379/52
(58) Field of Search ..... 340/506, 520, 340/691.6, 825.19, 825.36, 825.37, 286.02, 286.05, 286.06, 286.07, 293, 294, 309.4, 815.4, 815.69, 539.18, 3.1; 379/45, 52

(56) References Cited

U.S. PATENT DOCUMENTS 4,455,548 A * 6/1984 Burnett ..... 340/293
4,967,195 A * 10/1990 Shipley ..... 340/825.52
5,202,660 A * 4/1993 Hartman ..... 340/322
6,483,439 B1 * 11/2002 Vukosic ..... 340/815.65

* cited by examiner

*Primary Examiner*—Daryl Pope
(74) *Attorney, Agent, or Firm*—Leonard Tachner

(57) ABSTRACT

An alerting system for fire stations utilizes programmable message centers, zone-coded lighting and audio modules to alert only selected personnel for a particular type of emergency, i.e. fire, medical, etc. to decrease response time while reducing stress to remaining personnel who need not be alerted. Related features include night vision lighting, low level lighting, remote sensing and activation of station doors, ceiling mounted lighting signals, bed proximity audio alerts, automatic control of Emergency Response Facility audio sources and daisy-chain Ethernet cabling for simple installation.

8 Claims, 17 Drawing Sheets

FIRE DEPARTMENT STATION ZONED ALERTING CONTROL SYSTEM

CROSS-RELATED APPLICATIONS

This application is a divisional Utility patent application Ser. No. 09/544,068 filed Apr. 6, 2000 (now U.S. Pat. No. 6,535,121 Issued Mar. 18, 2003) which is based on Provisional Application Serial No. 60/128,464 filed Apr. 9, 1999.

BACKGROUND OF THE INVENTION

1. Field of the Invention

The present invention relates generally to fire station alert control and more specifically to a zoned alerting system distributed throughout a fire station to alert only those personnel who are pre-selected to respond to particular types of emergencies without unnecessarily stressing unselected personnel who are not required to respond.

2. Background Art

Response time is critical to successfully fighting fires and saving lives. The First-In® Fire Station Master Control Systems™ and its series of Smart Station™ remotes can shave valuable seconds off of response time in multi-company stations. Whether it is used by large metropolitan departments or small volunteer departments, First-In® integrates into the fire station at a cost that is affordable to all fire departments. An additional feature of First-In® is its ability to reduce stress levels on firefighters and paramedics. It is no secret that this industry produces an immense amount of stress and a good night of rest can be hard to find. First-In® is designed to both improve response time and reduce firefighter stress through the concept of zoning the fire station by company.

SUMMARY OF THE INVENTION

First In®and its series of Smart Station™ remotes utilize specially designed lighting to define zones within a fire station. Zone illumination from the Satellights™ establishes a particular light for each company housed within the station. For example the Engine Company is red, the Truck Company is blue, the Medic Company is green, the Ambulance Company is yellow, and the Battalion Chief is white. The color of the lights remains consistent throughout all remotes in the station. When First-In® is activated, the proper light color will illuminate. For example, if it is a medical emergency, all green (medic) lights in the station turn on, notifying the Medics to go. Personnel no longer need to wait for the dispatch transmission, but simply look at the remote lights and know instantly who is going to respond. This knowledge allows them to begin moving right away, resulting in improved response time.

Lack of sleep can diminish overall performance levels. Fire stations often receive calls throughout the night, awakening all personnel, even those who don't have to respond. This constant awakening can cause significant sleep deprivation. With the First-In® Dorm Remote™ module, only the personnel needed on the call are awakened. This remote module is mounted next to each bed. The occupant of that bed registers his or her company with his or her remote for that night. Thus, a Medic Call will only alert the First-In® Dorm Remote™ next to the Medic beds. The remaining personnel can continue to sleep.

In a preferred embodiment of the invention, the alerting control system comprises a plurality of function modules called Smart Station™ remotes and distributed throughout a fire station or other emergency response location. Such modules include Dorm Remotes™, Control Remotes™, Satellights™ and Silencers™. All of these remotes are interconnected in loop cabling configurations and controlled by a master control unit (MCU) referred to as First-In® which is, in turn, connected for activation by various alternative alarm data formats.

OBJECTS OF THE INVENTION

It is therefore a principal object of the present invention to provide a zoned alert system for multiple company emergency service sites such as fire stations and the like.

It is another object of the invention to provide a distributed alarm system for fire stations and other emergency service provider locations, which alarm system is designed to alert only specific personnel while permitting other personnel to sleep or otherwise remain at rest.

It is still another object of the invention to provide a fire station alarm system which employs distributed colored light alert devices and low level audio alert devices for waking only needed personnel without waking unneeded personnel.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1A:
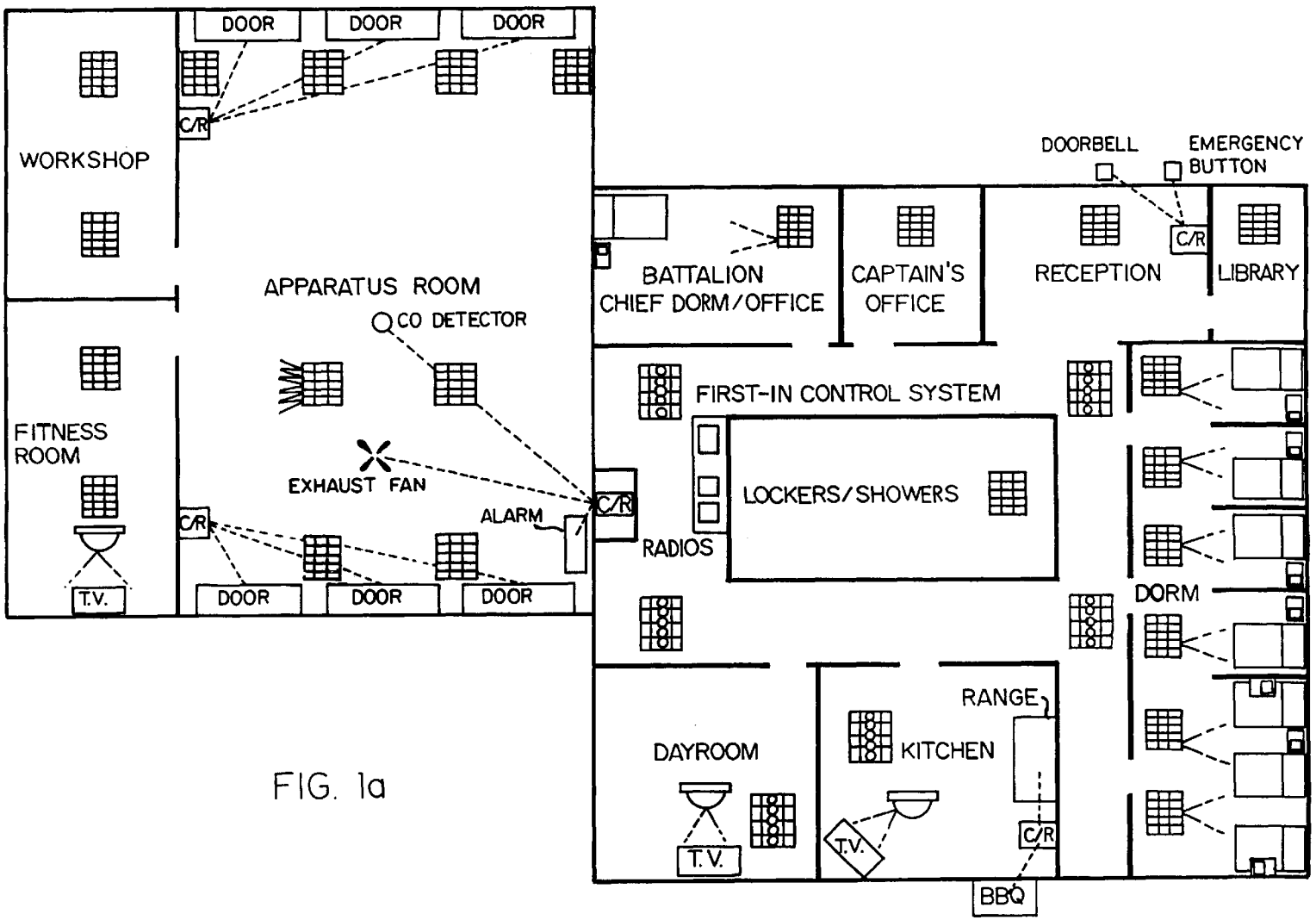
FIG. 1 comprising FIGS. 1*a* and 1*b* comprises a zoning layout drawing of a typical fire station in which the system of the invention is employed and an overview of typical interconnections between remotes.
Figure 1B:
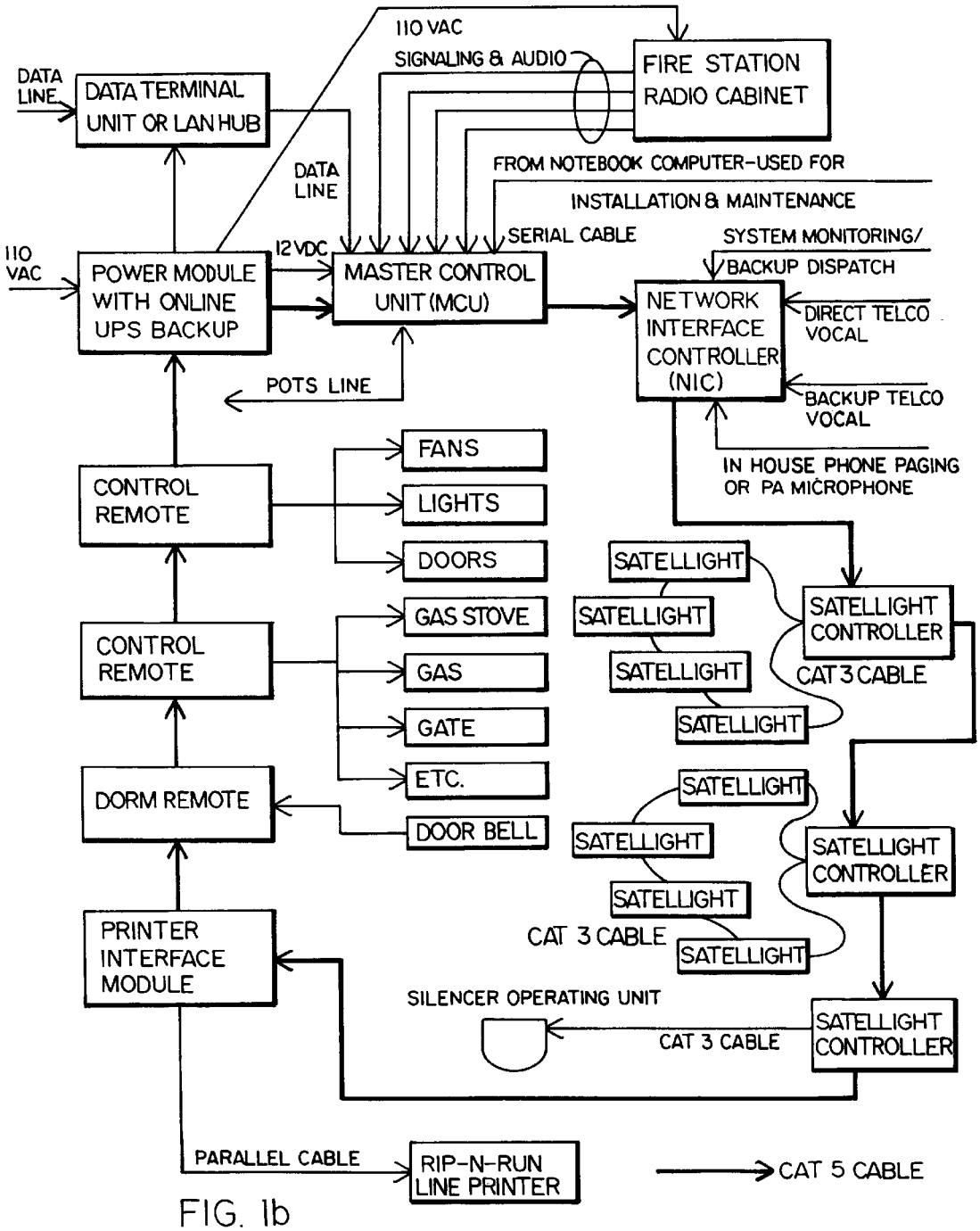

Fire Station Zoning (FIGS. 1*a* and 1*b*)

The Control System of the present invention is illustrated in a typical fire station layout shown in FIG. 1*a*. The fire station shown in FIG. 1*a* has a dormitory, a kitchen, a day room, a library, the Captain's office, the Battalion Chiefs dorm and office, lockers and shower, the apparatus room and adjacent work shop, and a fitness room. Each room is treated as one or more distinct zones. Each zone is provided with appropriate components of the system depending upon size, personnel, function and location. The dormitory is provided with a ceiling mounted light and audio component (Satellight™) for each one or two beds and a Dorm Remote™ for each bed. The day room has one such ceiling mounted component and a silencer component for automatically quieting a television set. The apparatus room has several ceiling mounted components and a control remote for each door. All such components are controlled by a First-In® master control device and are interconnected by an Ethernet cabling as shown in FIG. 1*b*.

As shown in FIG. 1*b*, the preferred embodiment of the invention provides a category 5 Ethernet connection loop wherein various functional remote modules are interconnected to a Master Control Unit (MCU). Aside from a UPS Backup module and a Network Interface Controller, each connected directly to the MCU, the loop interconnects a plurality of Control Remote™ modules, Dorm Remote™ modules and Satellight Controller™ modules, the function and operation of which will be described hereinafter. Each Satellight™ Controller module may be interconnected within a local category 3 Ethernet cable to a plurality of Satellights™ as also explained hereinafter. In addition, a Satellight Controller™ module may be connected by category 3 cable to a Silencer™ module. The MCU is connected to a Fire Station's radio cabinet and to the data terminal unit or LAN Hub. From these units the MCU receives signaling and audio information and data, respectively. The network interface controller monitors system operation and provides backup dispatch as well as telephone company interface and in-station telephone paging. A printer interface is also provide to connect to a printer through a parallel printer cable.

Figure 2A:
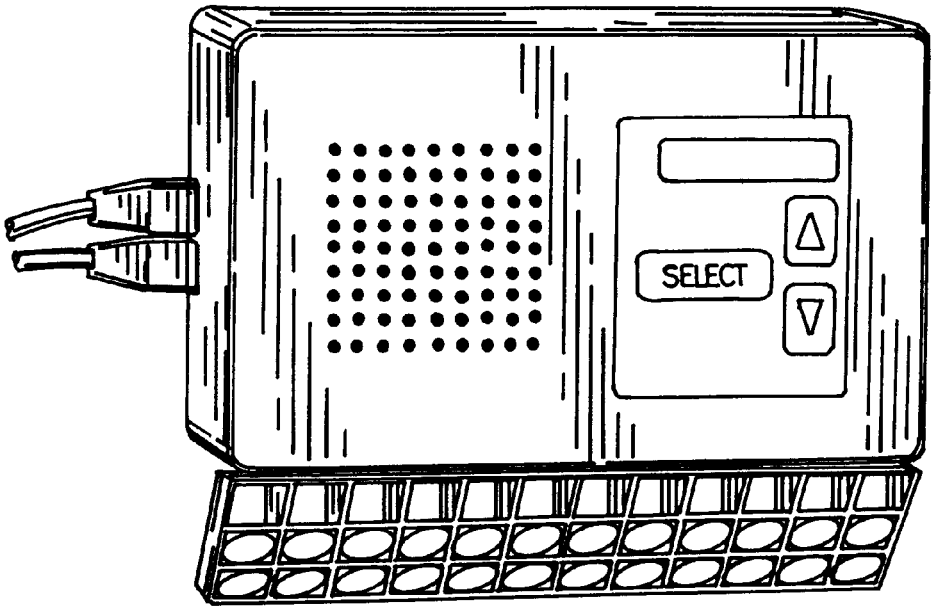
FIG. 2, comprising FIGS. 2*a* and 2*b*, comprises views of the Dorm Remote™ module of the invention and its block diagram.
Figure 2B:
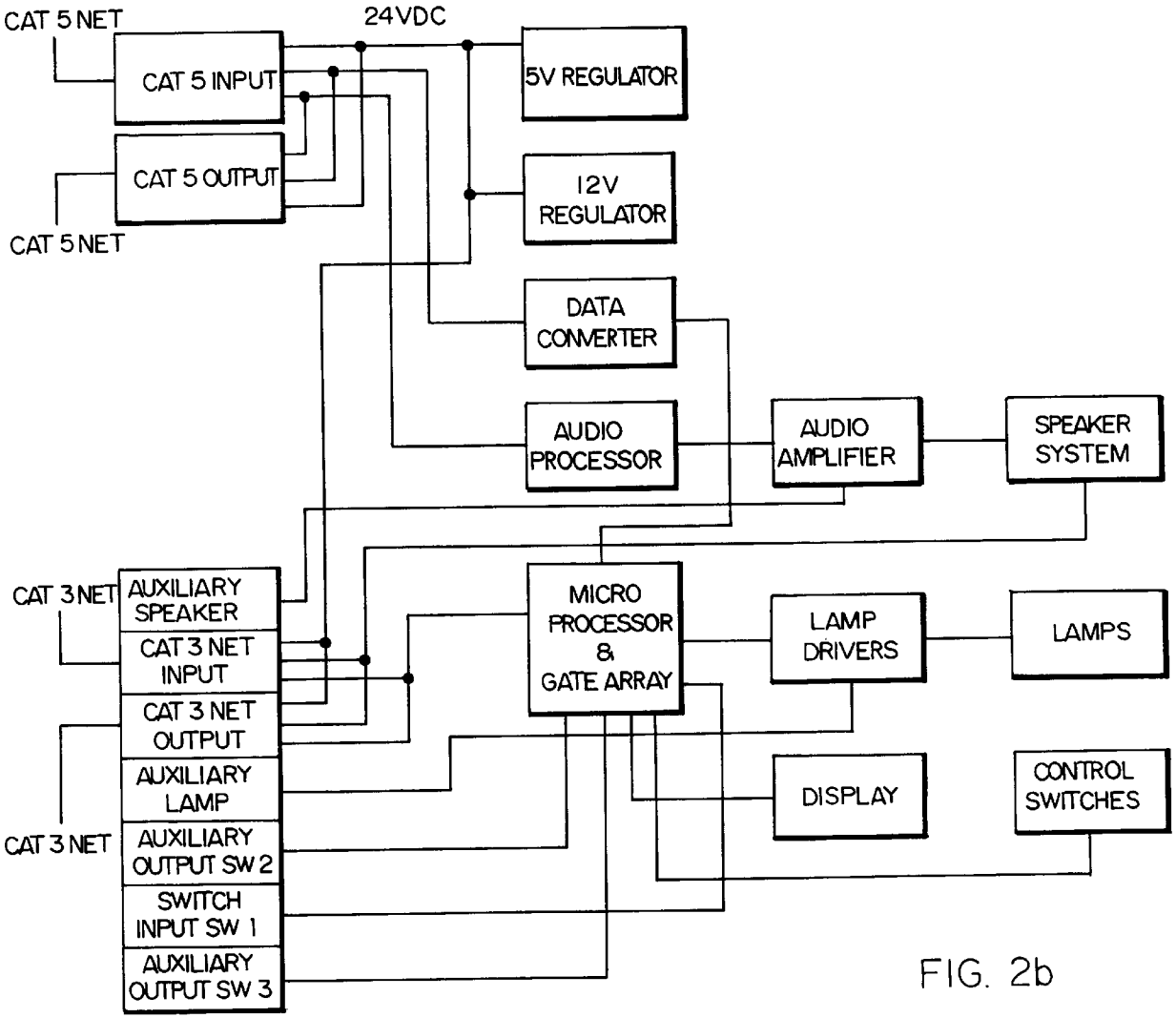

First-In® Dorm Remote™ (FIGS. 2*a* and 2*b*)

Mounted next to each bed in the dormitory, this module emits dispatch audio awakening only the personnel needed for the call. Features include night vision lighting and adjustable volume levels, radio monitoring, day and night volume levels, alpha-numeric display and programmable zone control.

The Dorm Remote™ is used in the First-In® Smart Station™ system to enable fire departments to separate a fire station into company specific zones by individual bed locations. The Dorm Remote™ receives commands from the First-In® Fire Station Master Control Systems over the Smart Station™ network that activates the Dorm Remote™ when the zone to which it is programmed is required to respond to an emergency situation. The Dorm Remote™ utilizing its night vision lighting system, illuminates the fireman's bed and sleeping area with light emitting diodes incorporated into a matrix parabolic lens assembly and displays the zone identification of the activated Dorm Remote™. It also amplifies and controls the preannouncement and dispatch audio levels with separate levels for daytime and nighttime. Night vision lighting levels are controllable from the front panel as well as the monitoring of the fire station radio system and the selection of which zone the Dorm Remote™ will respond to when the fire station is alerted to an emergency situation. An internal microprocessor communicates over the Smart Station™ network with the First-In® Fire Station Master Control System™ for the purposes of receiving zone alerts, programming authorization to change zone identification, performance evaluation test reporting and network integratory testing.

Dorm Remotes™ receive all power, data and audio information from category 5 network cabling connected to the RJ45 connectors. The network is configured in a continuous loop configuration enabling the Dorm Remotes™ to receive information from either direction on the loop and the identification of the exact location of any Dorm Remote™ for trouble shooting using it's unique network address. Normal loop operation places information on the loop in one direction and by detecting the information at the other end of the loop, verifies that the loop transported the information successfully, providing a completely supervised data transport network. The Dorm Remote™ built-in test function, monitors the performance of the Night vision lighting system, the audio, amplifier and control system and system power and at the completion of an alerting sequence, reports any out-of-specification condition to the First-In® fire station master control unit providing a completely supervised alerting system for the fire station.

Dorm Remotes™ are semiportable devices that may be relocated from time-to-time by fire department personnel to accommodate changing fire station requirements by simply unplugging the category 5 cabling, relocating the Dorm Remote™ to the new location and reconnecting the category 5 cabling. Reconnection of the category 5 cabling will automatically initiate a loop test by the First-In® Fire Station Master Control System™ and confirmation that the alerting is operating properly will be displayed on the system.

The above-noted functions of Dorm Remote™ modules are carried out by the components shown in FIG. 2*b*. As shown therein, each Dorm Remote™ module has category 5 and category 3 Ethernet interface capability, the former for First-In® loop interconnection and the latter for local connection to a device such as a door bell and the like which can be reduced in volume for nighttime operation. Also included are voltage regulators for 5V and 12V supply, a data converter interface to a microprocessor and gate array, the latter controlling the lighting levels, control switches and display for a selected sleeping area. An audio processor, amplifier and speaker control audio information in the immediate region of the Dorm Remote™ module.

Power Module:

First-In® has an internal Uninterruptible Power System (UPS). The UPS keeps First-In® operating in case of a power failure to the station. First-In® systems operate on low voltage DC power supplied by the power modules. First-In® and Smart Station™ technology help fire departments comply with NFPA 1221 requirements for constant electrical supervision.

Figure 3A:
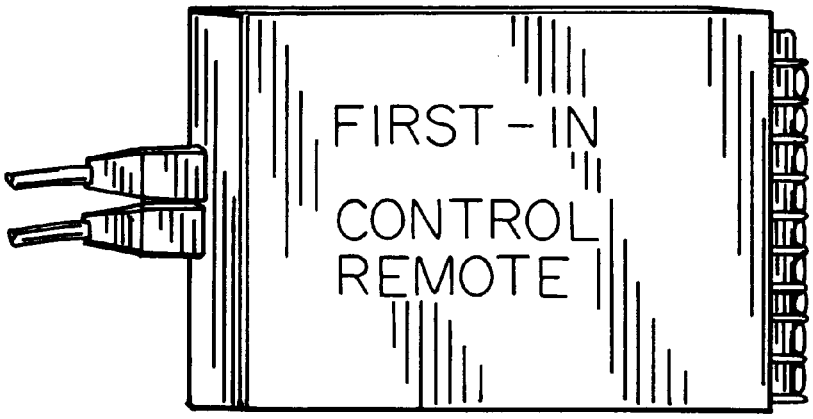
FIG. 3, comprising FIGS. 3*a* and 3*b*, comprises views of the Control Remote™ module of the invention and its block diagram.
Figure 3B:
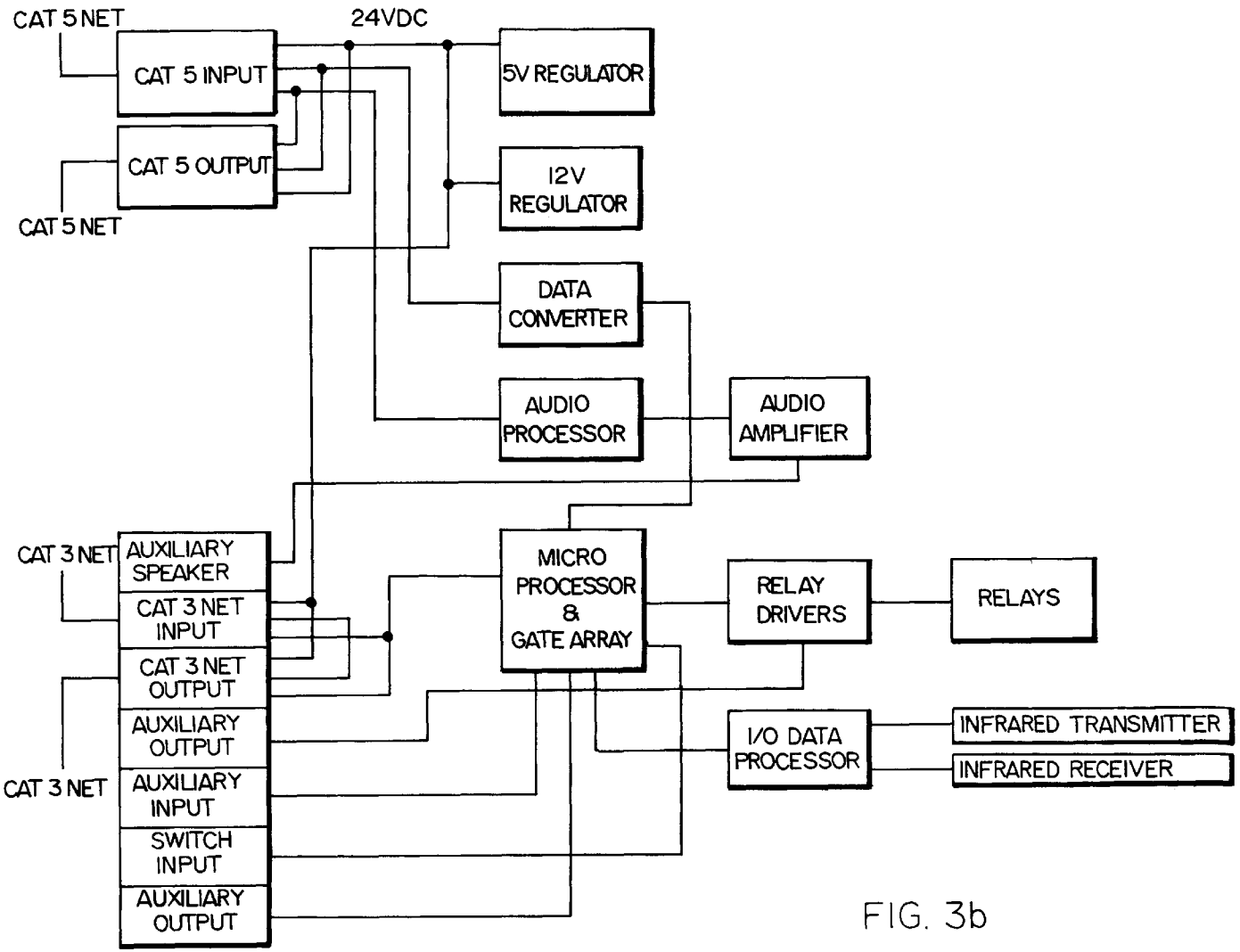

First-In® Control Remote™ (FIGS. 3*a* and 3*b*)

Control Remote™ executes commands from First-In® and performs a variety of tasks. These functions include reporting command malfunctions to fire personnel, monitoring station security, opening and closing station doors, turning off cooking burners, activating exhaust fans and other functions.

The Control Remote™ is used in the First-In® Smart Station™ system to enable fire departments to provide control and sensing of fire station and fire equipment functions. The Control Remote™ receives commands from the First-In® Fire Station Master Control System™ over the Smart Station™ network that activates the Control Remote's™ sensing and control functions when the fire station is required to respond to an emergency situation. The Control Remotes™ utilizing it's performance window evaluation software, executes commands received from the First-In® Fire Station Master Control System™ while evaluating the performance progress of each command function. The performance progress of the control function must meet the requirements of the pre-established window of acceptable performance or the control function is immediately terminated and the First-In® Fire Station Master Control System™ is notified of an unsuccessful control function. The First-In® Fire Station Master Control System™ immediately announces to the entire fire station the failure of the control function and notifies both dispatch and the monitoring center of the failed condition. An internal microprocessor communicates over the Smart Station network with the First-In® Fire Station Master Control System™ for the purposes of receiving control commands, performance evaluation test reporting and network integratory testing.

Control Remotes™ receive all power, data and audio information from category 5 network cabling connected to the RJ45 connectors. The network is configured in a continuous loop configuration enabling the Control Remote™ to receive information from either direction on the loop and the identification of the exact location of any Control Remotes™ for trouble shooting using a unique network address. Normal loop operation places information on the loop in one direction and by detecting the information at the other end of the loop, verifies that the loop transported the information successfully thereby providing a completely supervised data transport network. The Control Remote's™ performance window evaluation system monitors all control functions and provides supervised response to any out-of-specification condition with notification to the First-In® fire station control unit providing a completely supervised alerting system for the fire station.

Control Remotes™ are semiportable devices that may be relocated from time-to-time by fire department personnel to accommodate changing fire station requirements by simply unplugging the category 5 cabling, relocating the Control Remote™ to the new location and reconnecting the category 5 cabling. Reconnection of the category 5 cabling will automatically initiate a loop test by the First-In® Fire Station Master Control System™ and confirmation that the remote is operating properly will be displayed on the system.

As seen in FIG. 3*b*, the implementation of the Control Remote™ module is similar to that of the Dorm Remote™ module, but with relay drivers and relays being controlled by the microprocessor and gate array instead of lamps and displays.

First-In® Satellight™ (FIGS. 4*a*, 4*b*, 4*c* and 4*d*)

Satellights™ are the source of alarm audio for the entire station, replacing existing PA speakers. Mounted overhead through the station, Satellight™ light modules emit dispatch and paging audio as well as night vision lighting and company-specific light color. The Satellight Plus™ module includes all Satellight™ module functions, in addition to multi-channel background music and a back-up system for dispatch audio.

First-In® softens the shock of being awakened by night calls through the use of lowered volume levels and the Satellight™ Night vision lighting system. As soon as a call comes in and the firefighter awakens, the Satellight™ module emits a red glow of light, thus preserving the firefighter's night vision. This allows the trip from the dormitory to the apparatus room and onto the street to be made in the safest possible manner.

The Satellight™ and Satellight Plus™ modules are used in the First-In® Smart Station™ system to enable fire departments to provide Night vision lighting, zone active lighting and emergency situation preannouncements with dispatch audio to all locations in the fire station as well as eight channels of background music that are selectable by infrared remote control. The Satellight Plus™ module receives commands from the First-In® Fire Station Master Control System™ over the Smart Station™ network. These commands activate the Satellight Plus™ module when the fire station is required to respond to an emergency situation. The Satellight Plus™ module utilizing its Night vision lighting system, illuminates the interior of the fire station with light emitting diodes incorporated into a matrix parabolic lens assembly, displays the zone identification of the activated zone with colored light emitting diode lamps and amplifies and controls the pronouncement and dispatch audio levels with separate levels for daytime and nighttime. An internal microprocessor communicates over the Smart Station™ network with the First-In® Fire Station Master Control System™ for the purpose of receiving zone alerts, performance evaluation test reporting and network integratory testing.

Satellight Plus™ modules receive all power, data and audio information from category 5 network cabling connected to the RJ45 connectors. The network is configured in a continuous loop configuration enabling the Satellight Plus™ module to receive information from either direction on the loop and the identification of the exact location of any Satellight Plus™ module for trouble shooting using a unique network address. Normal loop operation places information on the loop in one direction and by detecting the information at the other end of the loop, verifies that the loop transported the information successfully, thereby providing a completely supervised data transport network. The Satellight Plus™ module's built-in test function, monitors the performance of the Night vision lighting system, the audio amplifier and the control system and system power at the completion of an alerting sequence, reports any out-of-specification condition to the First-In® fire master station control unit thus providing a completely supervised alerting system for the fire station.

Each Satellight Plus™ and Satellight™ module is a semiportable device that may be relocated from time-to-time by fire department personnel to accommodate changing fire station requirements by simply unplugging the category 5 cabling, relocating the module to the new location and reconnecting the category 5 cabling. Reconnection of the category 5 cabling will automatically initiate a loop test by the First-In® Fire Station Master Control System™ and confirmation that the alerting is operating properly will be displayed on the system.

Each Satellight Plus™ module is capable of driving remote Satellights™ as well as Silencer Remotes™, Control sense Remotes™, stationary alarm switches, and doorbell switches utilizing a self-contained category 3 network loop driven by the Satellight Plus™. One Satellight Plus™ module can operate up to four remote Satellights™ thereby producing the benefits of five separate Satellights™ from one Smart Station™ network node. The Satellight Plus™ background music system is operated by generic, television-type, remote controls enabling volume, channel, and mute control of the background music system without the conventional wall mounted volume controls thereby saving the cost and time of installing the conduit and cabling these controls require. The Satellight Plus™ module is designed to occupy a one-foot section of a four-foot acoustical ceiling panel enabling extremely fast installation of this system in new construction. Satellight Plus™ provides all the functions of the Satellight™ controller as well as providing a backup dispatch system with the use of the First-In® network interface controllers thereby establishing a truly independent alerting and dispatch capability within the agency, meeting all alerting and dispatch requirements for a class one fire department.

Figure 4A:
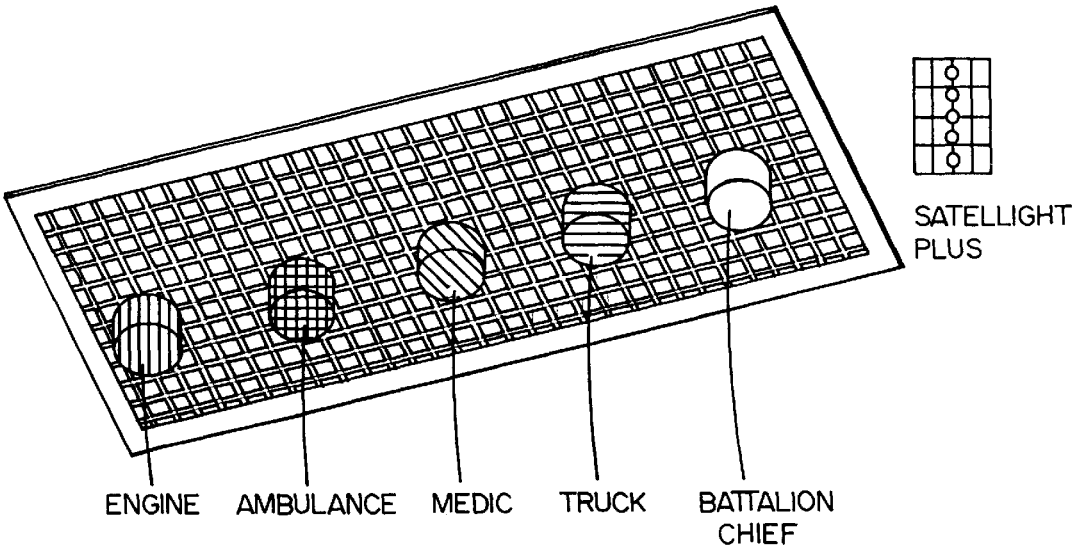
FIG. 4, comprising FIGS. 4*a*, 4*b*, 4*c* and 4*d*, comprises views of the Satellight Plus™ and Satellight™ colored light alert devices and their respective block diagrams.
Figure 4B:
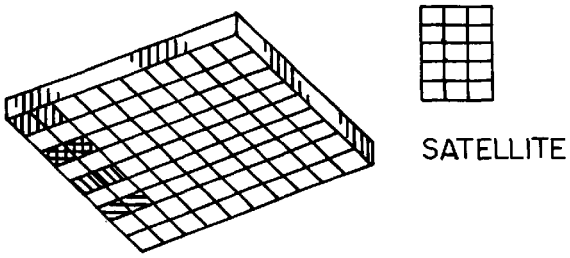
Figure 4C:
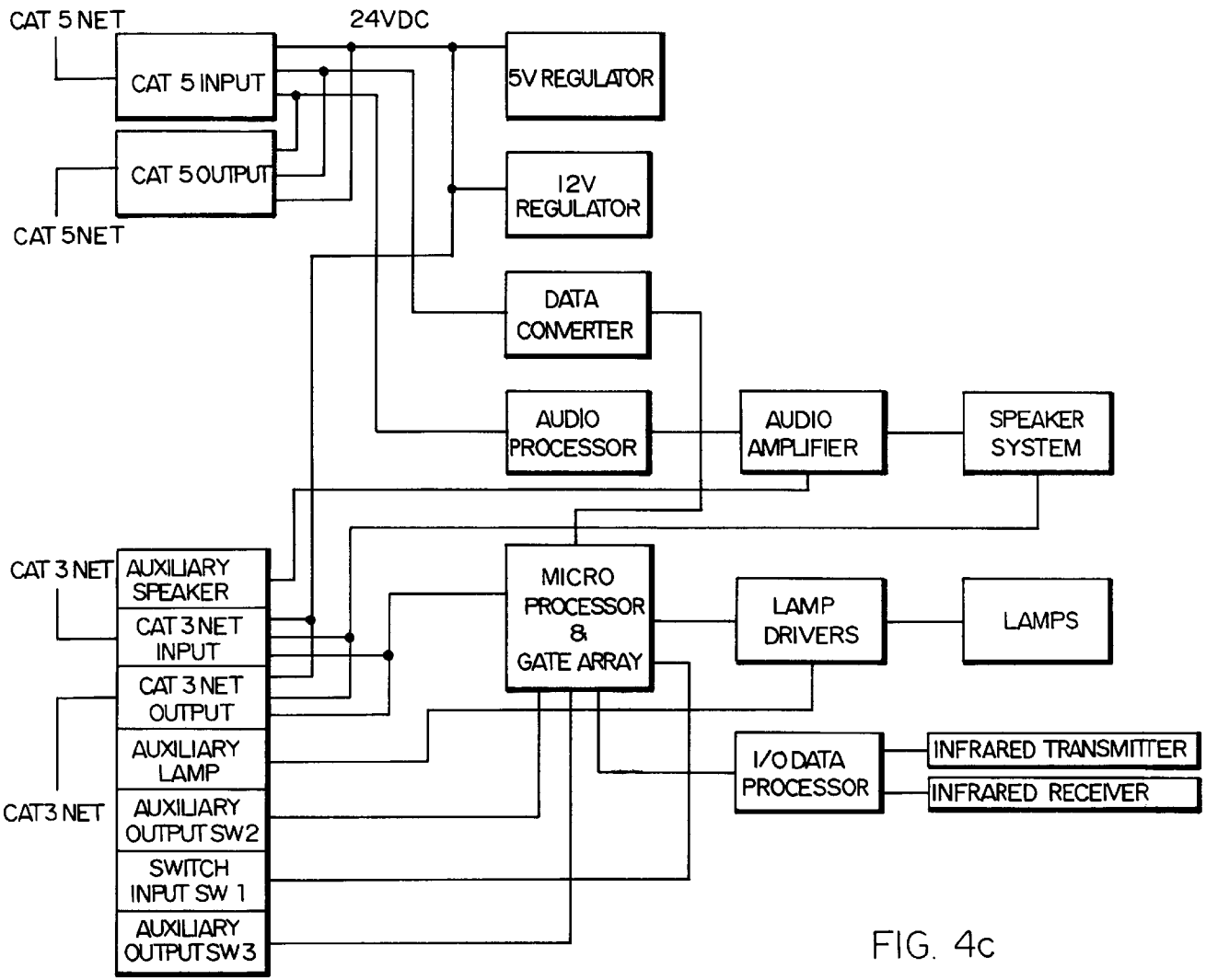
Figure 4D:
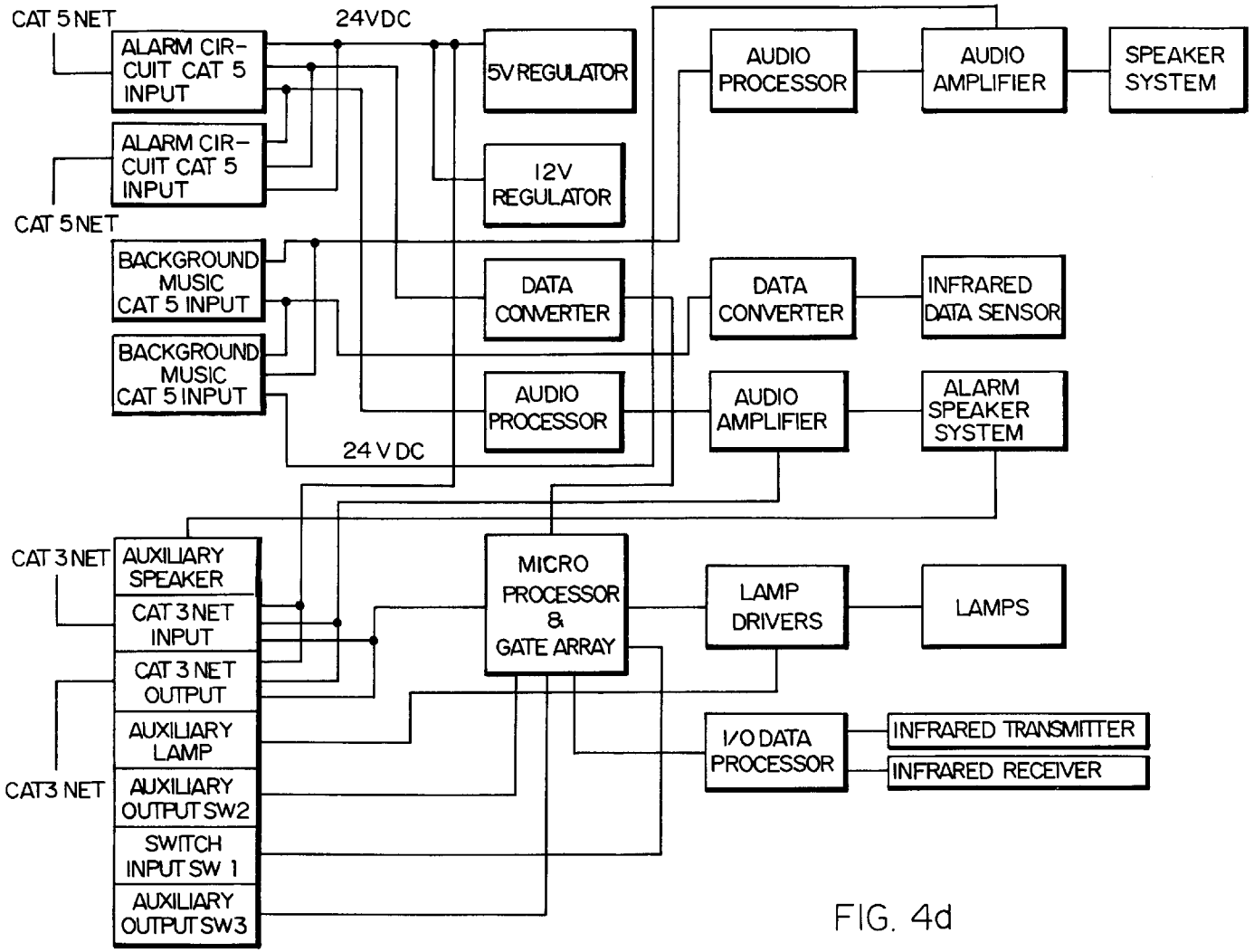

As seen in FIG. 4*c*, the Satellight™ Controller module replaces the relays and relay drivers of the Control Remote™ module with lamp drivers and lamps. However, the Satellight Plus™ module adds background music input and output interface as well as audio system capability and infrared capability remote control operation.

Figure 5A:
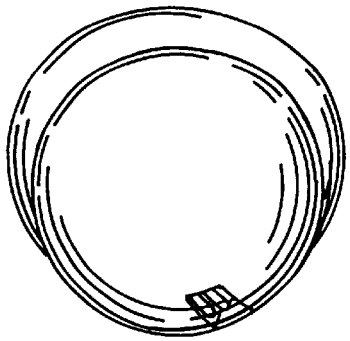
FIG. 5, comprising FIGS. 5*a*, 5*b* and 5*c*, comprises views of a Silencer™ module, a Silencer™ module in operation and a block diagram of a Silencer™ module.
Figure 5B:
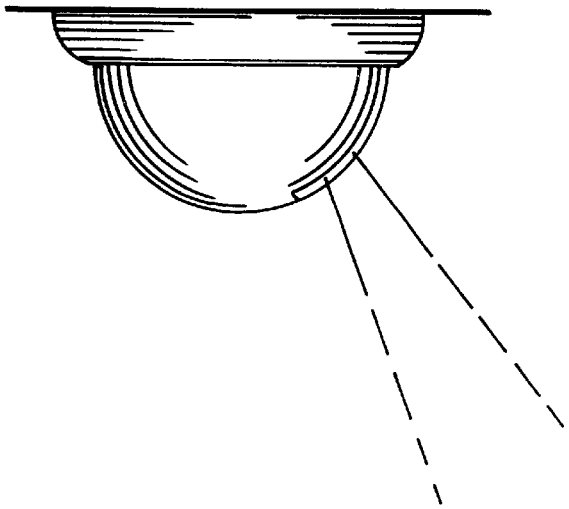
Figure 5B:
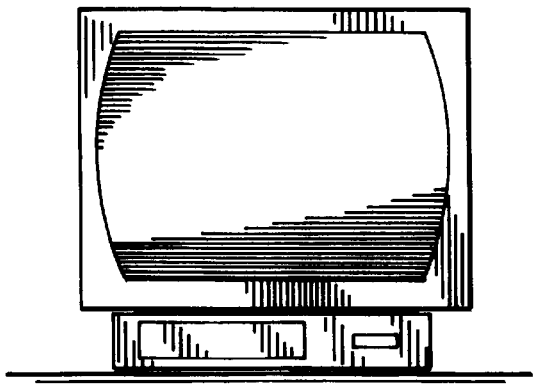
Figure 5C:
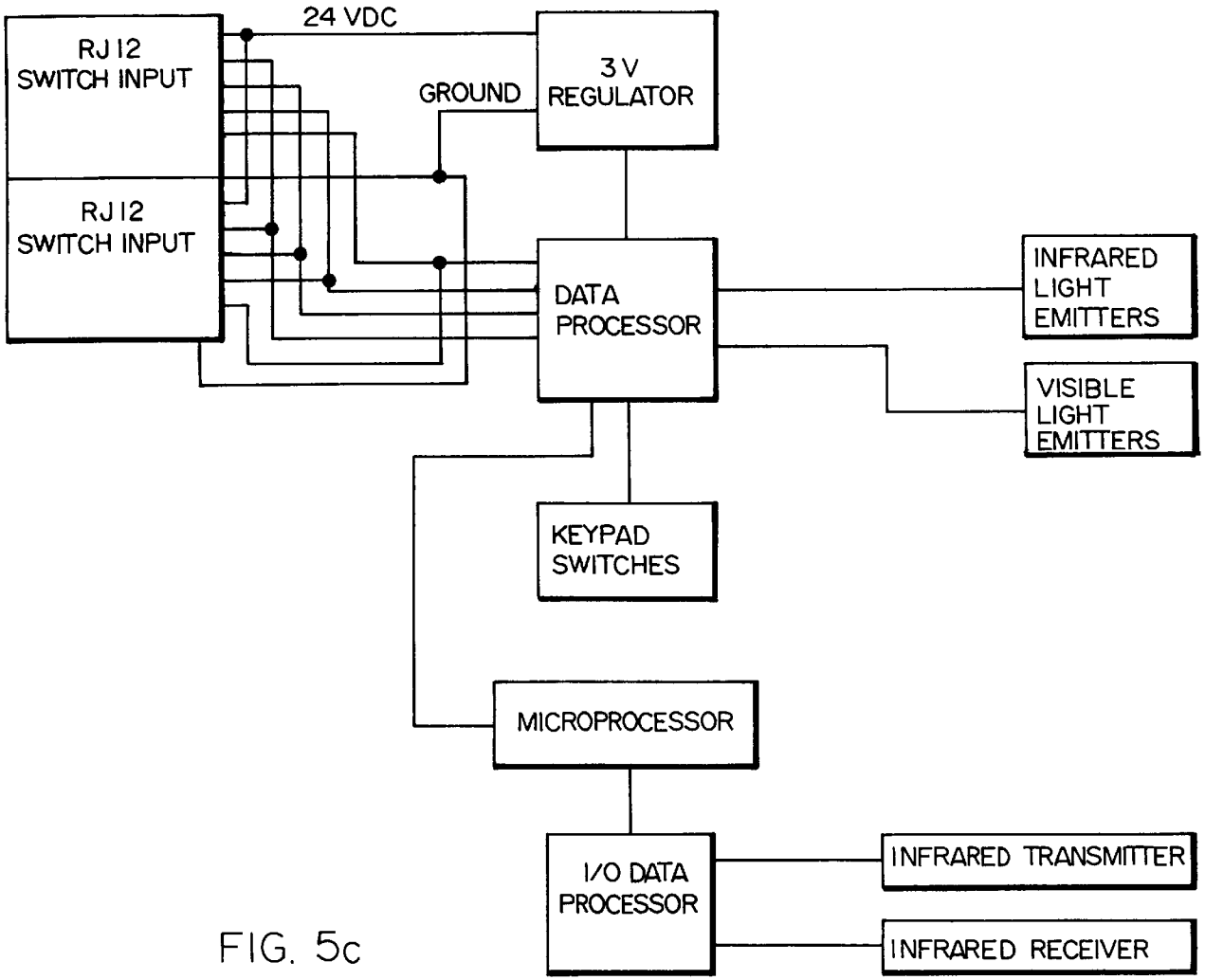

First In® Silencer™ (FIGS. 5*a*, 5*b* and 5*c*)

This module automatically mutes all TV and sound system audio during alarm sequences for clear recognition of dispatch transmissions. This feature is especially beneficial in high ambient noise level areas such as fitness rooms, kitchens and day rooms. FIG. 5*a* illustrates the ceiling mounted Silencer™ module and FIG. 5*b* illustrates the operation to control volume of a nearby television. FIG. 5*c* shows that in its implementation, the relays and relay drivers of the Control Module are replaced in the Silencer™ remote module with infrared emitters and drivers, respectively.

Figure 6A:
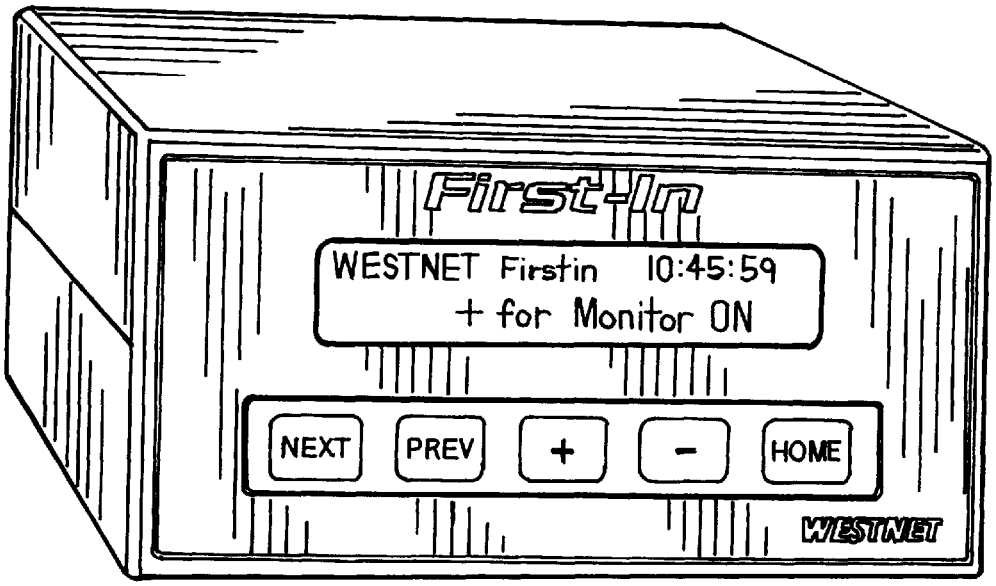
FIG. 6, comprising FIGS. 6*a* and 6*b*, comprises views of a First-In® master control module and its block diagram.
Figure 6B:
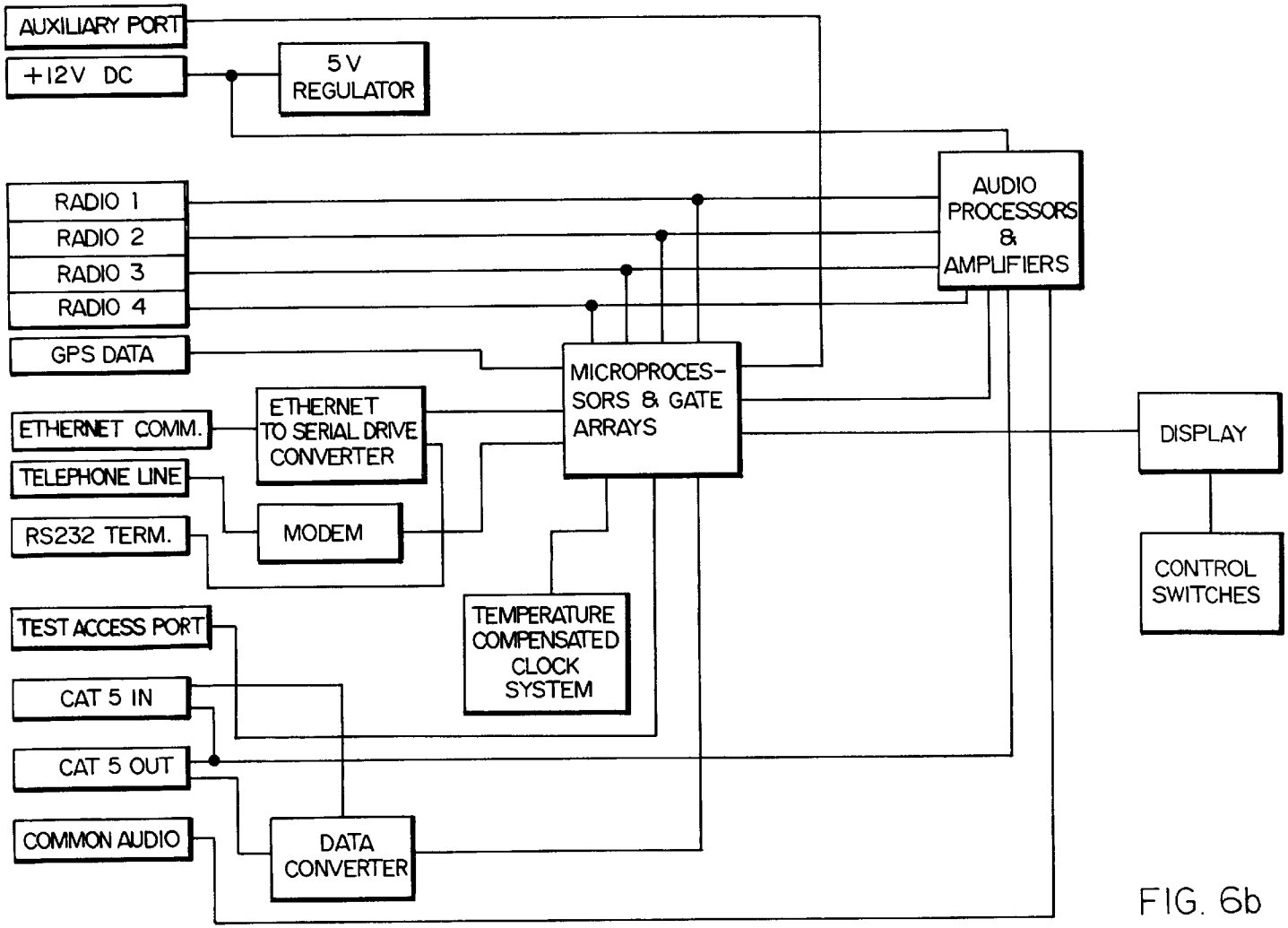

First-In® Features (FIGS. 6*a* and 6*b*)

First-In® MCU is the heart of a Fire Station Master Control System™ that uses human voice pre-announcement messages to notify fire personnel of an incident. First-In® communicates with the Smart Station™ remotes to meet individual station requirements. First-In® can be activated by radio, Computer Aided Dispatch (CAD), data, Ethernet input or by a telephone equipped with touch tone dialing capability. Together, First-In® and the Smart Station™ remotes offer programmable message centers, adjustable alarm levels, strategic zone illumination, night vision lighting and automatic reset of all First-In® equipment at the end of an alarm sequence. The MCU package is shown in FIG. 6*a* and the block diagram is provided in FIG. 6*b*. As seen in FIG. 6*b*, the MCU employs microprocessors and gate arrays having multiple communications interface capability from radio lines, a modem, RS232 line and Ethernet. It also provides audio, display and control switches as well as the system clock.

Figure 7:
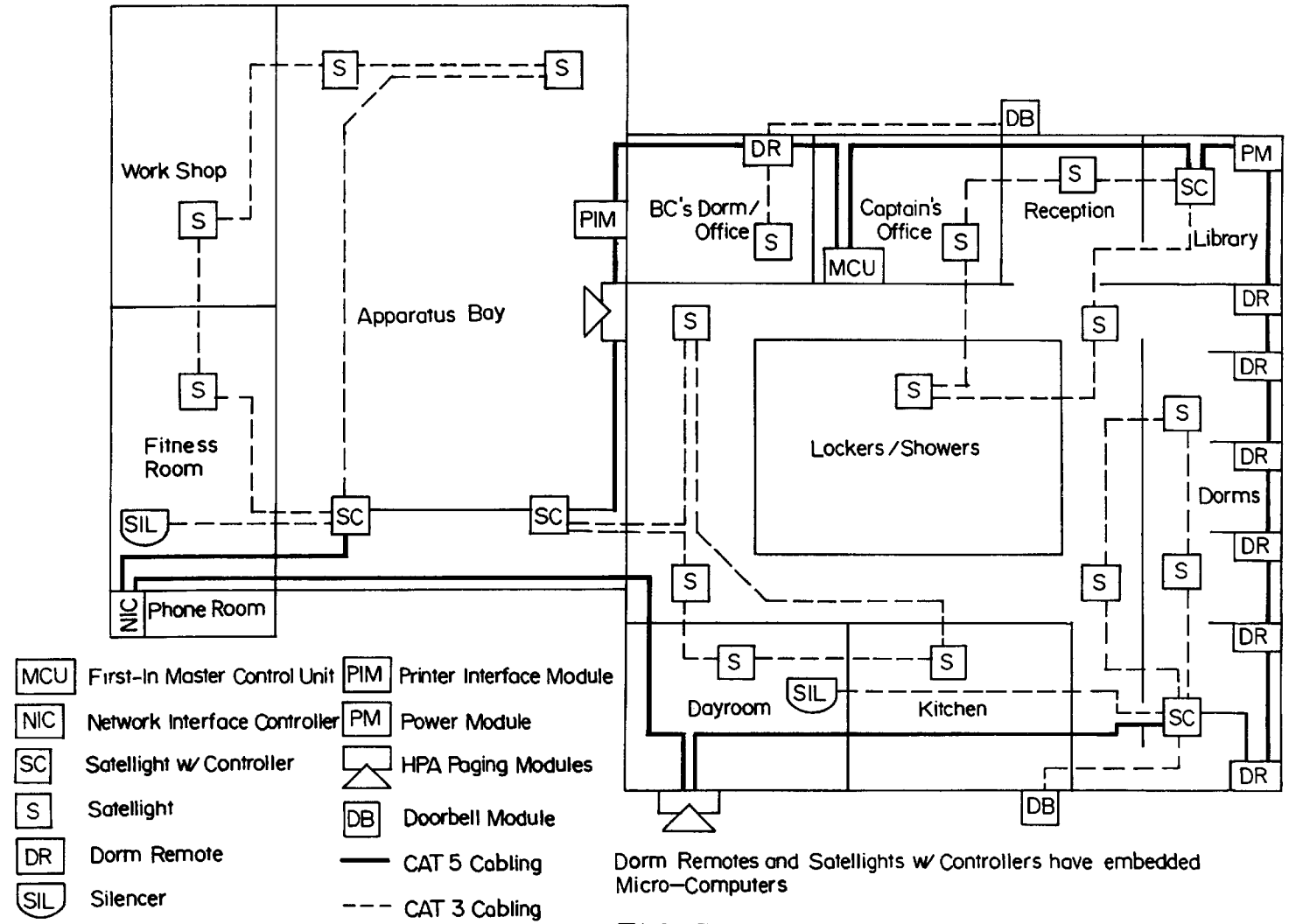
FIG. 7 is a typical cabling diagram for an entire fire station using the invention.

Category 5 Cabling (FIG. 7)

The First-In® systems use category 5 Ethernet cabling. This feature allows fire personnel to install First-In® and Smart Station™ remotes, thereby eliminating the costly installation of electrical wiring. FIG. 7 illustrates a typical cabling layout. As shown therein category 5 cabling interconnects the MCU and all remote modules that provide a control function. Category 3 cabling connects Satellights™ and Silencers™ to respective control modules via local loops.

Operation (FIGS. 8–11)

Figure 8:
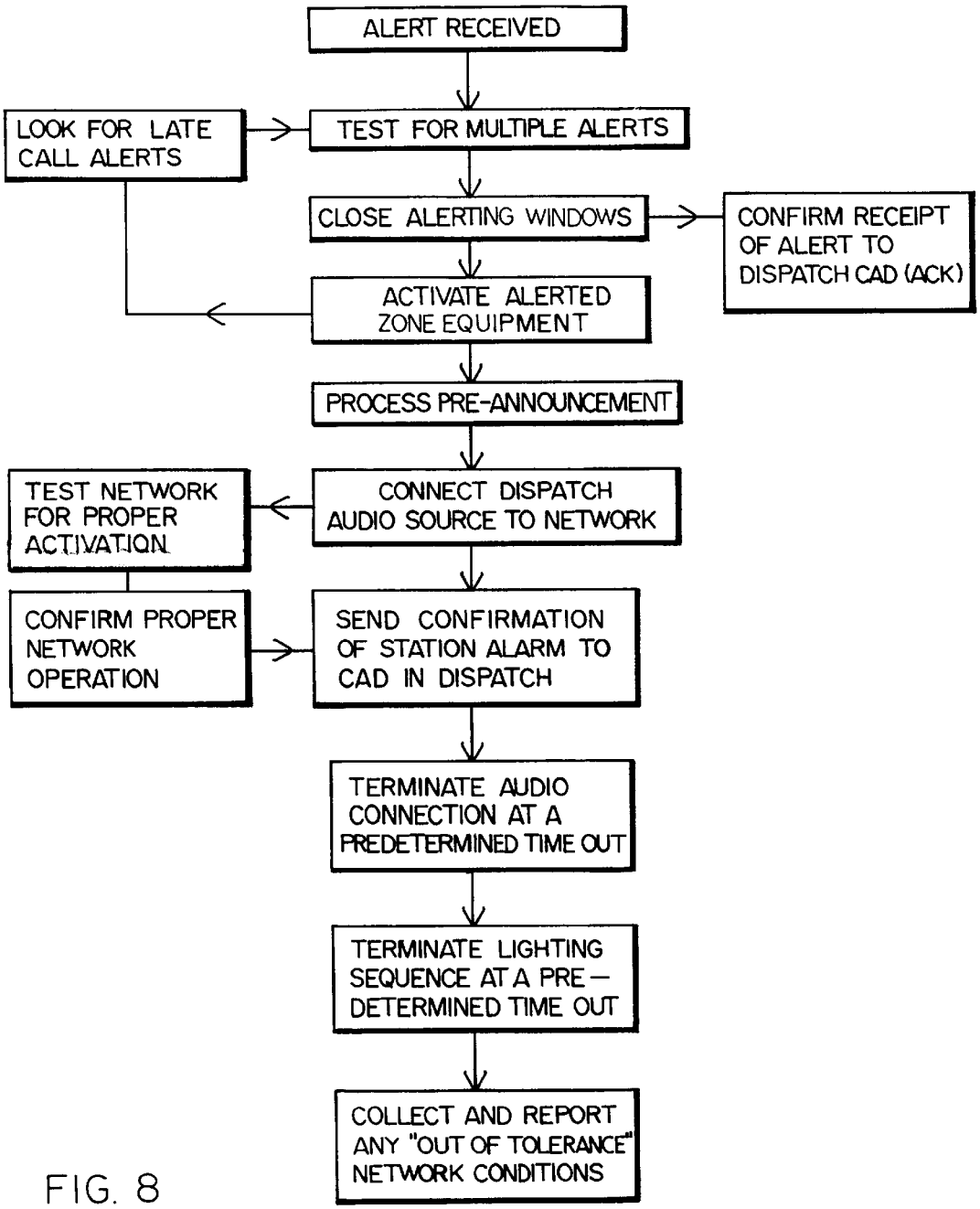
FIGS. 8–11 are flow chart diagrams depicting the operation of the invention.

Reference will now be made to FIGS. 8–11 which comprise various flow chart diagrams of operation of the preferred embodiment of the invention. As seen in FIG. 8, signal flow for a fire station dispatch commences with receipt of high speed dual tone multi-frequency (HSDTMF) or data commands from a dispatch center which is decoded by the MCU. After testing for multiple alerts, closing alerting windows and confirming receipt, the MCU then responds by activating night vision lighting and color zone lighting via Satellight Remote™ modules and Dorm Remote™ modules. The MCU then continues to look for late call alerts and sends pre-announcements to assigned units and process dispatch audio information while testing for proper activation. If the system is operating properly, confirmation of station alarm activation is returned to the computer aided dispatch (CAD) at the dispatch center. After a selected time-out period, the audio connection to the dispatch source is disconnected and the zoned and night vision lighting sequence is terminated. Finally, the system collects and reports all "Out of Tolerance" network conditions to the dispatch center and monitoring facilities.

Figure 9:
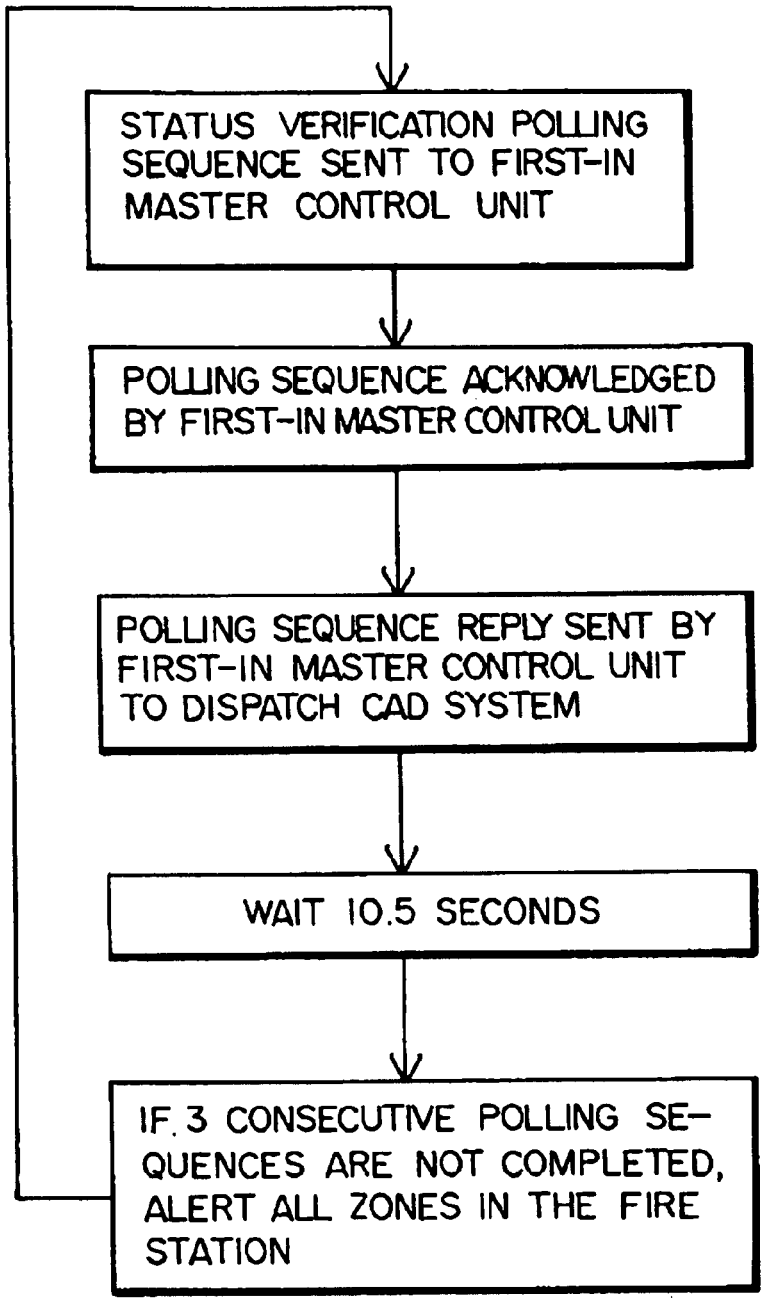

FIG. 9 illustrates a polling sequence between the MCU and the dispatch center's CAD system designed to assure that communications between the CAD system and the MCU are uninterrupted. A polling status verification sequence is sent to the MCU by the CAD system from the dispatch center. The MCU acknowledges receipt and replies. After 10.5 seconds the process is repeated. If three consecutive polling sequences are not completed, the alert control system of the invention will automatically alert all zones in the fire station.

Figure 10:
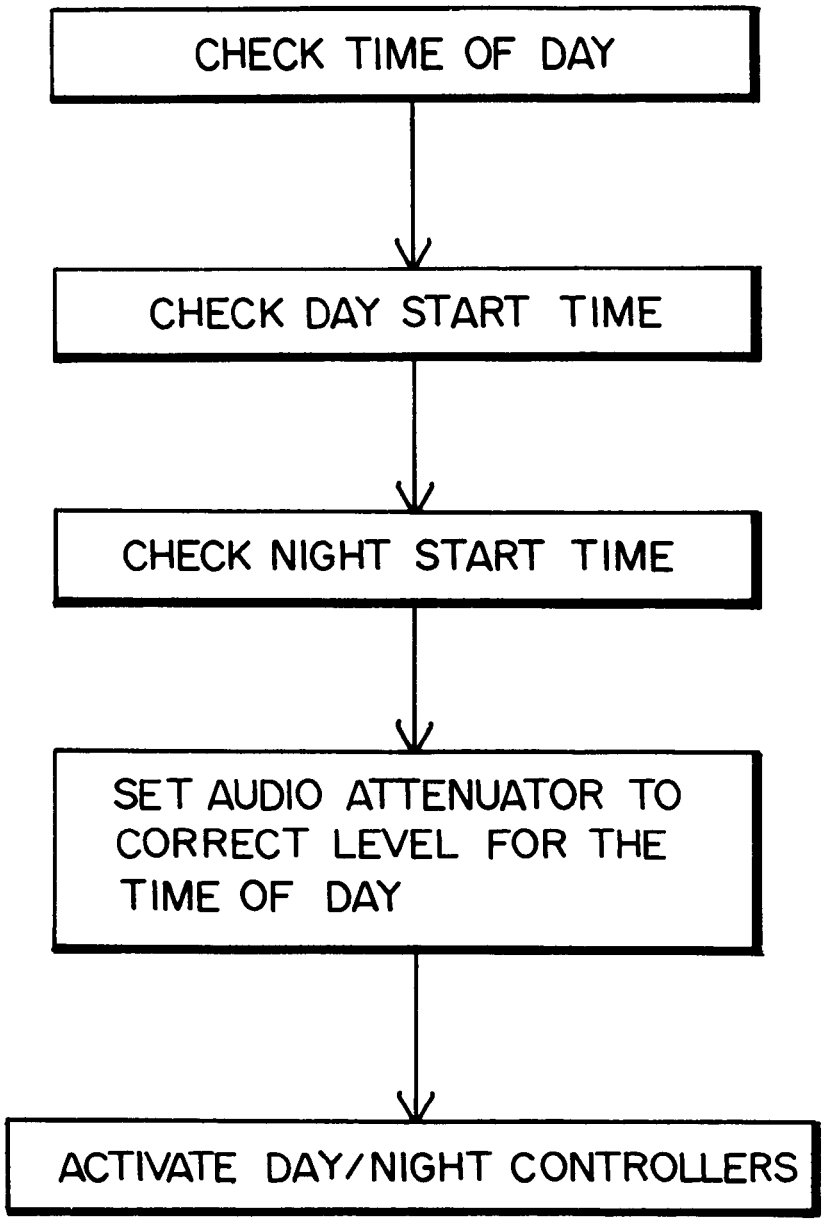

FIG. 10 illustrates the day/night flow used in the present invention. Time of day is checked against a preset day start time and a preset night start time. Audio attenuators and light level controllers are then set based upon wether time of day is in the day or night portions of the cycle.

Figure 11:
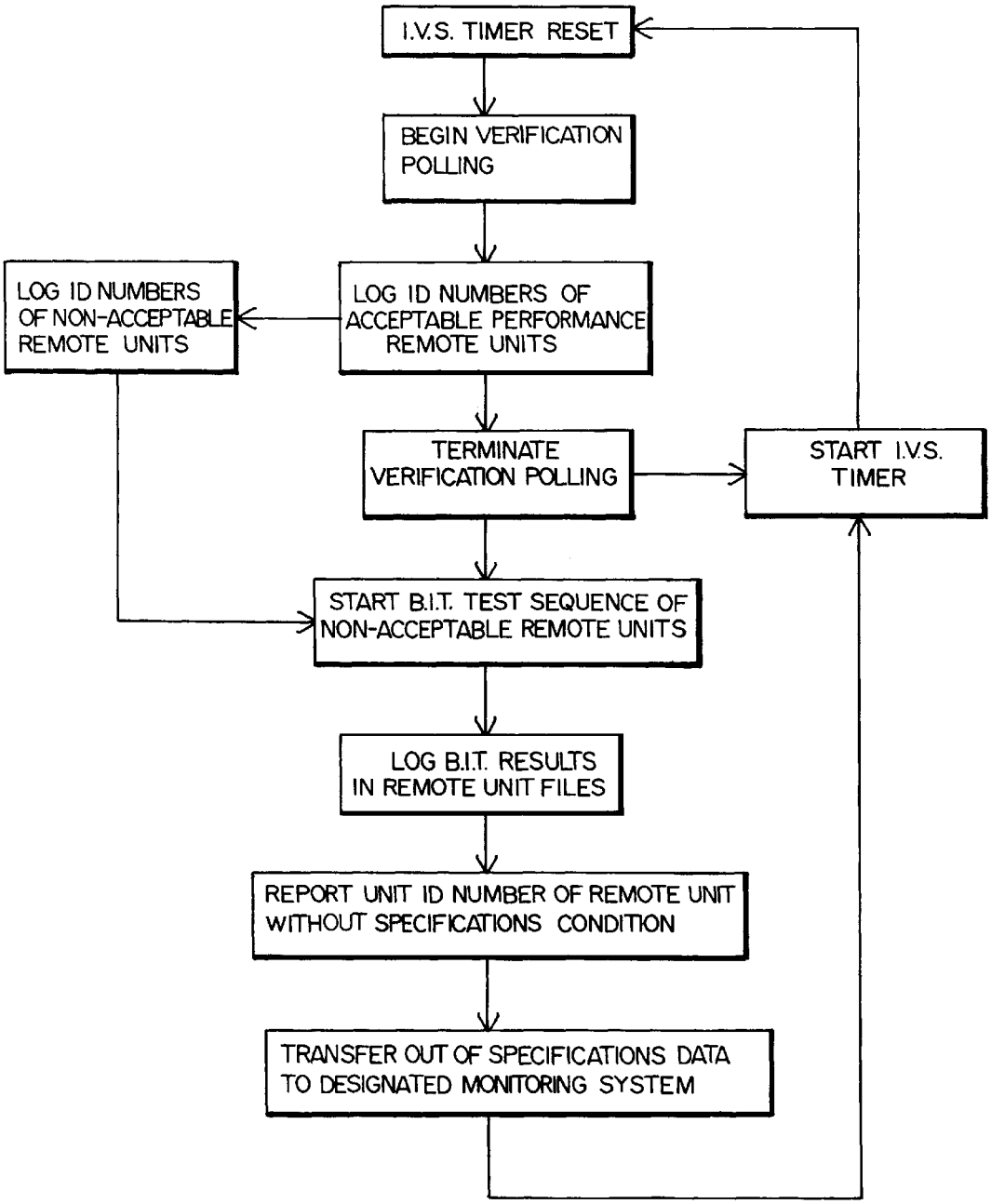

FIG. 11 illustrates the Network Integrity Verification Sequence between the MCU and the various system modules to verify that all "BIT" Built In Test results are within the windows of acceptability for each module. This sequence is similar to the status verification sequence shown in FIG. 9, but includes a diagnostic program to permit automatic fault location to a particular circuit within a specific module on the Smart Station Network. After completion of the diagnostic program, the test results are displayed on the MCU display and transmitted to the dispatch center or monitoring facility.

Having thus disclosed a preferred embodiment of the present invention, it being understood that numerous modifications and additions are contemplated and will now be apparent as a result of the disclosure made herein,

What is claimed is:

1. An alert control system for use in a fire department facility having at least two dispersed groups of fire department personnel, a first such group designated for responding to a first type of emergency and a second such group designated for responding to a second type of emergency; the system comprising:

a master control unit for receiving an alert command from a remote emergency dispatch communications source and for generating zoned alert control signals in response to each such command;

a plurality of remote modules for distribution to various locations throughout said fire department facility, said remote modules each controlling a respective multicolored array of lights, each color of light corresponding to a respective one of said fire department personnel groups, said plurality of modules being connected to said master control unit; and microprocessors in said master control unit and in said remote modules for responding to said first type of emergency by activating a selected light color to alert said first group to said emergency.

2. The alert control system recited in claim 1 at least one of said remote modules controlling an audio amplifier for selectively attenuating an audio announcement during an alert depending upon whether said amplifier is located adjacent personnel of said first group or personnel of said second group.

3. The alert control system recited in claim 1 at least one of said remote modules controlling an infrared emitter for reducing the volume of an adjacent audio device's sound level during an emergency.

4. The alert control system recited in claim 1 at least one of said remote modules controlling at least one relay for selectively switching on or switching off an electrical apparatus in said fire department facility during an emergency.

5. The alert control system recited in claim 1 wherein said master control unit and said plurality of remote modules are interconnected along a closed data communications loop.

6. An alert control system for use in a fire department site having at least two groups of fire department personnel, a first such group designated for responding to a fire type of emergency and a second such group designated for responding to a medical type of emergency; the system comprising:

a master control unit for receiving an alert command from a remote fire department dispatch communications source and for generating alert control signals in response to each such command;

a plurality of remote modules for distribution to various locations through out said site, at least one of said remote modules controlling at least one relay for selectively switching on or switching off an electrical apparatus during an emergency, said plurality of modules being connected to said master control unit; and microprocessors in said master control unit and in said remote modules for responding to said fire type of emergency by activating a relay for switching on or switching off an electrical apparatus during an emergency.

7. The alert control system recited in claim 6 wherein said master control unit and said plurality of remote modules are interconnected along a closed data communications loop.

8. An alert control system for a network of fire department facilities having multiple companies of personnel for emergency response to different types of emergencies; the system comprising:

means for generating emergency response alerting by company specific vertical zones distributed throughout each said fire department facility;

means for interactive sensing and control of facility equipment, night vision, colored lighting and alerting configuration; and means for supervising alarm circuits from a remote fire department dispatch center to a master control unit and remote modules throughout each said facility.

* * * * *